US009815215B2

(12) United States Patent
Uit De Bulten et al.

(10) Patent No.: US 9,815,215 B2
(45) Date of Patent: Nov. 14, 2017

(54) VARIABLE CUTTING LENGTH HAIR CLIPPING SYSTEM

(71) Applicant: KONINKLIJKE PHILIPS N.V., Eindhoven (NL)

(72) Inventors: Raymon Henk Uit De Bulten, Hattemerbroek (NL); Jelle Wouter Wijbrandi, Groningen (NL); Harold Molendijk, Bleiswijk (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 396 days.

(21) Appl. No.: 14/360,845

(22) PCT Filed: Nov. 26, 2012

(86) PCT No.: PCT/IB2012/056724
§ 371 (c)(1),
(2) Date: May 27, 2014

(87) PCT Pub. No.: WO2013/080114
PCT Pub. Date: Jun. 6, 2013

(65) Prior Publication Data

US 2014/0331503 A1 Nov. 13, 2014

Related U.S. Application Data

(60) Provisional application No. 61/564,118, filed on Nov. 28, 2011.

(51) Int. Cl.
*B26B 19/20* (2006.01)
*B26B 19/12* (2006.01)

(52) U.S. Cl.
CPC ..... *B26B 19/20* (2013.01); *B26B 19/12* (2013.01); *B26B 19/205* (2013.01)

(58) Field of Classification Search
CPC ... B26H 19/20; B26H 19/205; B26H 19/3813
(Continued)

(56) References Cited

U.S. PATENT DOCUMENTS 1,516,635 A * 11/1924 Friedman ..... B26B 19/205 30/202
2,726,447 A * 12/1955 Maloy ..... B26B 19/205 30/202

(Continued)

FOREIGN PATENT DOCUMENTS

EP 0325326 B1 4/1991
EP 1295686 A1 3/2003

(Continued)

*Primary Examiner* — Stephen Choi
*Assistant Examiner* — Fernando Ayala

(57) ABSTRACT

A hair clipping device including a housing; a cutting assembly arranged on one end of said housing including a stationary blade with a front edge and a moveable blade with a toothed edge arranged parallel to said front edge of the stationary blade, wherein the moveable blade is displaceably mounted on a surface of the stationary blade; a drive arrangement driving said moveable blade in an oscillatory movement in a transverse direction substantially parallel to the front edge of the stationary blade; an adjustment unit adjusting the position of the moveable blade with respect to the stationary blade in a first direction substantially perpendicular to said transverse direction; and a comb attachment releasably attached to the hair clipping device; wherein the adjustment unit adjusts the position of the comb attachment with respect to said cutting assembly in a second direction substantially perpendicular to said surface of the stationary blade.

14 Claims, 8 Drawing Sheets

(58) Field of Classification Search
USPC ..... 30/200, 233, 233.5, 201
See application file for complete search history.

(56) References Cited

U.S. PATENT DOCUMENTS

| | | | | | |
|---|---|---|---|---|---|
| 2,731,720 | A * | 1/1956 | Henard | B26B 19/20 | 30/201 |
| 3,430,342 | A * | 3/1969 | Wahl | B26B 19/205 | 30/201 |
| 4,274,199 | A * | 6/1981 | Gallanis | B26B 19/10 | 30/34.1 |
| 4,614,036 | A * | 9/1986 | Haraguchi | B26B 19/205 | 30/200 |
| 4,622,745 | A * | 11/1986 | Wahl | B26B 19/20 | 30/201 |
| 4,776,095 | A * | 10/1988 | Tsujimoto | B26B 19/20 | 30/201 |
| 4,845,852 | A * | 7/1989 | Sukow | B26B 19/20 | 30/132 |
| 4,940,460 | A * | 7/1990 | Casey, I. et al. | A61M 5/30 | 604/131 |
| 5,084,974 | A * | 2/1992 | Sukow | B26B 19/20 | 30/201 |
| 5,325,589 | A | 7/1994 | Kubo | | |
| 5,367,772 | A * | 11/1994 | Ogawa | B26B 19/205 | 30/201 |
| 6,260,276 | B1 | 7/2001 | Lebherz et al. | | |
| 6,279,234 | B1 * | 8/2001 | Chaouachi | B26B 19/20 | 30/200 |
| 7,921,566 | B2 * | 4/2011 | Yamaguchi | B26B 19/06 | 30/200 |
| 8,341,846 | B1 * | 1/2013 | Holmes | B26B 19/205 | 30/200 |
| 8,479,400 | B2 | 7/2013 | Bukutani | | |
| 8,844,142 | B2 * | 9/2014 | Kammer | B26B 19/20 | 30/201 |
| 2002/0095793 | A1 * | 7/2002 | Wilcox | B26B 19/20 | 30/201 |
| 2005/0246902 | A1 | 11/2005 | Poran | | |
| 2006/0107529 | A1 * | 5/2006 | Kostner | B26B 19/063 | 30/43 |
| 2007/0107234 | A1 * | 5/2007 | Yao | B26B 19/06 | 30/201 |
| 2007/0227011 | A1 * | 10/2007 | Caric | B26B 19/20 | 30/123 |
| 2008/0178468 | A1 | 7/2008 | Liao | | |
| 2008/0196252 | A1 * | 8/2008 | Mikula | B26B 19/20 | 30/79 |
| 2009/0188117 | A1 * | 7/2009 | Putzer | B26B 19/20 | 30/201 |
| 2012/0216411 | A1 * | 8/2012 | Wevers | B26B 19/20 | 30/123 |
| 2013/0263457 | A1 * | 10/2013 | Sobagaki | B26B 19/205 | 30/201 |

FOREIGN PATENT DOCUMENTS

| | | | |
|---|---|---|---|
| JP | 6223617 | A | 2/1987 |
| JP | 05317537 | A | 12/1993 |
| WO | 2006134576 | A2 | 12/2006 |

* cited by examiner

VARIABLE CUTTING LENGTH HAIR CLIPPING SYSTEM

CROSS-REFERENCE TO PRIOR APPLICATIONS

This application is the U.S. National Phase application under 35 U.S.C. §371 of International Application No. PCT/IB2012/056724, filed on Nov. 26, 2012, which claims the benefit of, U.S. Provisional Patent Application No. 61/564,118, filed on Nov. 28, 2011. These applications are hereby incorporated by reference herein.

FIELD OF THE INVENTION

The present invention relates to a hair clipping system, in particular to a hair clipping system that is adapted to variably adjust the length of the hair-cut. The invention further relates to a hair clipping device for use in such a hair clipping system.

BACKGROUND OF THE INVENTION

Electric haircutting appliances are generally known, and include trimmers, clippers and shavers whether powered by main supplied electricity or batteries. Such devices are generally used to trim body hair, in particular facial and head hair to allow a person to have a well-groomed appearance.

Commonly, conventional devices for cutting hair comprise a main body forming an elongated housing having a front or cutting end and an opposite handle end. A cutting blade assembly is disposed at the cutting end. The cutting blade assembly usually includes a stationary blade element and a movable blade element which moves in a reciprocal manner against the stationary blade element. The cutting blade assembly itself extends from the cutting end and is usually fixed in a single position relative to the main body of the hair clipper, such that the orientation of the cutting blade assembly is determined by a user orientating the main body of the device.

Since there is a great user demand for a hair clipping systems that offer the possibility to be used for different haircut lengths, many known hair clipping systems make use of separate, differently sized comb attachments. These comb attachments are generally mounted to the cutting end of a conventional hair clipping device to position the cutting blade assembly relative to the skin. In other words, such a comb attachment is used as a guide that moves over the skin and guides hair towards the cutting element. Typically, these comb attachments are mounted over the cutting blade assembly and spaces the cutting blades away from the surface of the skin from which the hairs extend.

In order to adjust between different possible cutting lengths the comb attachments may be movably mounted on the hair clipper. Users may thus shift the comb attachment between different positions leading to different haircut lengths. Usually these moveable comb arrangements may be adjusted between haircut lengths of 3 mm, 5 mm, 7 mm, 9 mm, usually up to 10 mm. These systems, however, include the disadvantage that they only allow for haircut lengths of 2.5 mm or 3 mm and above, since these lengths are usually the smallest lengths that can be reached with the comb attachment in its shortest position. Of course, the user may also use the hair clipping device without comb attachment, usually leading to a haircut length of 0.3 mm. However, haircut lengths in between these limit ranges, i.e. in between 0.3 mm and 2.5 mm or 3 mm, cannot be accomplished with such systems.

Further hair clippers are known from the prior art that allow an adjustment for smaller cutting length ranges, i.e. between 0.3 mm and 2.5 mm. These systems usually allow an adjustment of the position of the movable cutting blade with respect to the stationary cutting blade in order to increase the distance between these blades. Such a device is, for example known from U.S. Pat. No. 5,367,772 A.

The cutter head of this device includes a toothed stationary blade and a toothed movable blade reciprocating on the stationary blade in a hair shearing engagement between the individual toothed edges. The movable blade is slidable relative to the stationary blade in an edgewise direction perpendicular to the reciprocating motion of the movable blade for varying the haircut length. An adjustor handle is slidably fitted on an outer round surface of the housing and linked to the movable blade through a linkage member such that the movable blade is shifted in the edgewise direction to increase or reduce the cut length by rotating the adjustor handle about a longitudinal axis of the housing. A similar hair clipping device of this kind is known from U.S. Pat. No. 6,260,276 B1.

The hair clippers disclosed in the above-mentioned two prior art documents only allow a cutting length adjustment between 0.3 mm and 2 mm, up to maximally 3 mm. These devices therefore only enable an adjustment within a very small length adjustment range, and cannot be used for larger cutting lengths. This, of course, leads to a small flexibility for the user.

SUMMARY OF THE INVENTION

Therefore, it is an object of the present invention to provide a hair clipping system which substantially alleviates or overcomes the problems mentioned above and allows for a variable and easy adjustment of the hair cut length over a large cutting length range without the need of a plurality of additional parts. It is furthermore an object to simplify the handling of the system and improve the cutting performance.

This problem is solved with a hair clipping system of the kind mentioned initially, which hair clipping system comprises a hair clipping device that comprises:

a housing;

a cutting assembly which is arranged on one end of said housing and comprises a stationary blade with a front edge and a moveable blade with a toothed edge arranged parallel to said front edge of the stationary blade, wherein the moveable blade is displaceably mounted on an upper surface of the stationary blade and resiliently biased against said surface of the stationary blade;

a driving arrangement for driving said moveable blade in an oscillatory movement in a transverse direction substantially parallel to the front edge of the stationary blade;

an adjustment unit for adjusting the position of the moveable blade with respect to the stationary blade in a first adjustment direction substantially perpendicular to said transverse direction; and wherein said hair clipping system further includes a comb attachment with a plurality of comb teeth that can be releasably attached to the hair clipping device on a side of the stationary blade facing away from said surface of said stationary blade to create a defined gap between the comb teeth, that are adapted to at least partly surround the cutting assembly, and the moveable blade;

wherein the adjustment unit is adapted for adjusting the position of the comb attachment with respect to said cutting assembly in a second adjustment direction substantially perpendicular to said surface of the stationary blade if the comb attachment is attached to the hair clipping device.

Preferred embodiments of the invention are defined in the dependent claims. It shall be understood that the claimed hair clipping device has similar and/or identical preferred embodiments as the claimed hair clipping system and as defined in the dependent claims.

The presented hair clipping system thus provides a smart solution to adjust the movable blade and the comb attachment using the same adjustment unit. Users may therefore either use the hair clipping device without comb attachment and adjust the desired hair cut length by adjusting the position of the movable blade relative to the stationary blade by moving it forward and backward on the stationary blade in the first adjustment direction, or, in case longer haircut lengths are desired, users may adapt the hair cut length by adjusting the position of the comb attachment with respect to the cutting assembly in the second adjustment direction. Both adjustments can be made with the same adjustment unit.

The adjustment of the movable blade in first adjustment direction is usually used to adjust between shorter hair cut lengths, e.g. between 0.3 mm and 2 mm. The adjustment of the comb attachment is instead usually used to adjust between longer hair cut lengths, e.g. between 2.5 mm and 10 mm. Using only one adjustment unit for both ways of adjusting the haircut length significantly increases the user friendliness and simplifies the usage of the hair clipping system.

In contrast to the above-mentioned prior art the possible cutting length range is significantly increased, since cutting lengths are achievable between 0.3 mm and 10 mm without complicated additional parts or extra equipment. The adjustable comb attachment also supersedes the usage of a whole comb attachment set including a plurality of comb attachments which correspond to the different desired haircut lengths.

It has to be noted that in accordance with one or more embodiments of the presented hair clipping system, if the comb attachment is used, the adjustment unit is adapted for positioning the movable blade and the comb, as well as it includes the fact that the adjustment unit is adapted for positioning only the comb attachment (if the comb attachment is attached to the hair clipper). This means that in case the comb is attached, the adjustment unit may be used to only adjust the comb attachment, as well as it may be used to adjust the position of both sub-systems (the movable blade and the comb attachment).

The said adjustment unit may be realized in many ways. One example is the usage of an adjustable lever that is moveably mounted with the housing and be used to adjust the position of the moveable blade and/or the comb attachment. Another possibility is to manually move the moveable blade and/or the comb attachment with a pusher or slider. Furthermore, it is conceivable to use a motor driven adjustment. One of the preferred adjustment techniques according to the present invention is the usage of a rotatable adjustment wheel that allows to adjust the position of the moveable blade and/or the comb attachment by a turning movement of said wheel.

The adjustable distance between the toothed edge of the movable blade and the front edge of the stationary blade, measured in the first adjustment direction, is also denoted as tip-to-tip distance. This tip-to-tip distance defines the resulting haircut length when the hair clipping device is used separately without the comb attachment. In case a comb is attached, the resulting haircut length is defined by the distance measured in the second adjustment direction between the cutting blade assembly and the comb teeth of the comb. It is to be noted that the term "hair cut length" does not define the length of the hairs that are cut away, but defines the length of the hairs that are left over on the skin.

However, using the attachable comb generally complicates the operation of the device and may lead to a worse cutting performance compared to a usage without a comb. This relies on the fact that hairs will have more difficulties to enter further through the comb teeth into the system due to obstacles, such as the comb teeth and the enlarged distance to be traveled to the cutting assembly. Especially in cases where the comb attachment is positioned far away from the cutting assembly (in order to achieve longer haircut lengths), the distance for the hairs to travel to the cutting assembly might become so large that the cutting performance is severely affected.

According to an embodiment of the present invention, the comb attachment therefore further comprises a blocking element that is adapted to block the adjustment of the position of the moveable blade with the adjustment unit and to push the moveable blade to a predefined position along the first adjustment direction, if the comb attachment is attached to the hair clipping device.

The above-mentioned predefined position of the movable blade is preferably a position where the toothed edge of the movable blade is, seen in the first adjustment direction, in its foremost position with respect to the front edge of the stationary blade. In other words, this preferred position leads to the smallest possible tip-to-tip distance which in practice is preferred to be less than 0.6 mm, even more preferably around or equal to 0.3 mm. Tip-to-tip distance smaller than 0.3 mm are also conceivable and technically possible. However, a too small tip-to-tip distance also increases the risk that users cut themselves. A distance of 0.3 mm has shown to be a good trade-off.

The solution thus allows moving the movable blade automatically to its foremost position when a comb is attached to the hair clipping device. Therefore, the above-mentioned disadvantage is overcome and the best performance with respect to hair catching is also delivered when using the additional comb attachment. Of course, the moveable blade could also be manually moved to its foremost position in case a comb is attached to the hair clipping device. However, the solution according to this embodiment moves the moveable blade automatically to this preferred position, so that the user will not have to think about it.

In other words, the tip-to-tip adjustment setting, i.e. the connection of the adjustment unit to the movable blade, is disconnected or overruled, so that the adjustment unit is adapted to only adjust the position of the comb attachment in the second adjustment direction in case a comb is attached. At the same time the blocking element of the comb attachment pushes the movable blade to its preferred, foremost position.

According to a further embodiment the adjustment unit thereto comprises a releasable connection with the moveable blade for adjusting the position of the moveable blade in the first adjustment direction, which connection is mechanically released by the blocking element of the comb attachment, thereby blocking the adjustment of the position of the moveable blade with the adjustment unit, if the comb attachment is attached to the hair clipping device.

The term "blocking" in this respect means releasing the connection between the adjustment unit and the movable blade. The blocking element can, for example, be realized by a housing part of the comb attachment which protrudes to the inside of the housing when the comb is attached and mechanically shifts a carriage element to which the movable blade is connected forward in the first adjustment direction. The carriage element may thereto be arranged at a position where the blocking element of the comb attachment is inserted into the housing, so that during the attachment of the comb the blocking element automatically contacts the carriage element and pushes it to the preferred, most forward position. Since the blocking element at the same time also releases the connection of the adjustment unit with the movable blade, the adjustment unit is only adapted to position of the comb attachment in the second adjustment direction, while an adjustment of the movable blade is no longer possible if the comb is attached.

It has to be noted that the blocking element can also be a simple straight wall that is configured to contact the moveable blade or a carriage element that is connected to the moveable blade. The blocking element itself may also be a part of the moveable blade or said carriage element that is configured to contact the comb attachment or parts of it as soon as the comb attachment is attached to the housing. For the technical principle, it does not matter whether the blocking element, e.g. a protruding housing part, is part of the comb attachment or the moveable blade or the carriage element, as long as attaching a comb attachment to the clipping device results in a disconnection of the adjustment of the moveable blade with the adjustment unit and a movement of the moveable blade towards its preferred, foremost position.

According to a further preferred embodiment, the adjustment unit comprises an adjustor handle that is arranged on or within the housing of the clipping device, which adjustor handle is rotatable around its central axis, wherein a rotational movement of the adjustor handle causes a movement of a slider to which it is connected, wherein the slider is linked to the moveable blade so as to activate a movement of the moveable blade in the first adjustment direction, and wherein the slider is connected to the comb attachment activating a movement of the comb attachment in the second adjustment direction if the comb attachment is attached to the clipping device.

The rotatable adjustor handle is also denoted as zoom wheel. Zoom wheel adjustment mechanisms are known as such, e.g. from EP 0 325 326 B1. Said zoom wheel directly drives a slider which moves both, the comb and the movable blade. Said zoom wheel is preferably formed as a symmetric wheel that may be arranged on or within the housing of the hair clipping device, wherein it is preferred that the central axis of the zoom wheel is substantially parallel to the longitudinal axis of the housing. The zoom wheel thus easily enables the user to adjust the desired hair cut length by rotating it about its central axis. The rotation of the zoom wheel may, for example, cause a movement of the above-mentioned slider in a slider direction. This slider direction may, for example, be substantially parallel to the longitudinal axis of the housing. However, the slider may also be bent or inclined with respect to the longitudinal axis of the housing.

In a practical appliance, the zoom wheel may, for example, be arranged in the middle part of the housing or at the rear part of the housing. Depending on the technical design the zoom wheel may be adapted to simultaneously adjust the position of the comb and the movable blade. Since only one slider is used according to this embodiment the movement of the comb is in this case directly linked to a movement of the movable blade.

Since such a technical design may lead to the above-mentioned disadvantages, the single zoom wheel setting may also be combined with the blocking feature mentioned above. If the comb attachment or the carriage element that is connected to the moveable blade comprise the above-mentioned blocking element the slider-to-movable blade connection is released as soon as a comb is attached, meaning that the zoom wheel is in this case adapted to only adjust the position of the comb attachment. This leads to a preferred situation, wherein only one zoom wheel is able to adjust both settings, the tip-to-tip setting if no comb is attached and the comb setting if a comb is attached.

However, this setting may for some smaller reasons sometimes also be unwanted. Depending on the technical design of the slider and the connection to the movable blade and/or to the comb, it may occur that a turning of the zoom wheel in a specific direction at the same time results in an increase of the tip-to-tip distance as well as in a movement of the comb away from the cutting assembly. In other words, the distance for hair to travel to the cutting assembly becomes very large, since the distances of both subsystems are increased at the same time. If the technical design is changed in a way that turning the zoom wheel in a specific direction results in a decrease of the tip-to-tip distance and simultaneously in an increase of the distance between the comb and the cutting assembly, this problem is compensated, but not solved. In this case the movement of the zoom wheel would mean different things for both sub-systems, i.e. turning right would mean longer hair with respect to the tip-to-tip adjustment, but shorter hair with respect to the comb adjustment. This might be difficult to understand for a consumer and could thus lead to a confusion of the user.

According to a further embodiment, the adjustment unit may thus comprise two independent adjustment elements, a first adjustment element for adjusting the position of the moveable blade in said first adjustment direction, and a second adjustment element for adjusting the position of said comb attachment in said second adjustment direction if the comb element is attached to the hair clipping device. This allows to independently adjusting the tip-to-tip distance and the position of the comb attachment.

Such an adjustment with two independent adjustment elements can, for example, be implemented by an adjustment unit that comprises two independent adjustor handles that are arranged on or within the housing of the clipping device, which adjustor handles are rotatable around their common central axis, wherein a rotational movement of the first adjustor handle causes a movement of a first slider to which it is connected, wherein the first slider is linked to the moveable blade so as to activate a translational movement of the moveable blade in the first adjustment direction, and wherein a rotational movement of the second adjustor handle causes a movement of a second slider to which it is connected, wherein the second slider is connected to the comb attachment activating a movement of the comb attachment in the second adjustment direction if the comb attachment is attached to the clipping device.

The technical design of the adjustor handles/zoom wheels may in this case be adapted such that turning each zoom wheel in the same direction results in the same situation for both adjustment subsystems, i.e. increasing the tip-to-tip distance and increasing the distance of the comb to the cutting assembly when turning each zoom wheel to the right, and vice versa for a left turn. This simplifies the handling for the user and does not longer lead to the above-mentioned confusions. However, similar as mentioned-above also other adjustment techniques are generally possible that allow an independent adjustment of the tip-to-tip setting and the comb setting.

However, it is to be noted that the same technical effect may also be achieved with only one zoom wheel. According to an embodiment, wherein said two independent adjustment elements are connected to a single adjustor handle, wherein activating the adjustor handle causes a movement of the first adjustment element which is linked to the moveable blade so as to activate a movement of the moveable blade in the first adjustment direction, and wherein activating the adjustor handle causes a movement of the second adjustment element which is linked to the comb attachment so as to activate a movement of the comb attachment in the second adjustment direction if the comb attachment is attached to the hair clipping device.

In this case, the single adjustment handle/zoom wheel is connected to the movable cutting blade via a first adjustment element and to the comb attachment via a second adjustment element (in case a comb is attached). The technical principle remains the same. For example by providing two guidances within the inner part of the zoom wheel that are oppositely arranged to each other, so that rotating the zoom wheel in rotation direction in both cases (comb attached or not) leads to a larger cutting length, independent if the comb is attached or not. Using only one zoom wheel furthermore includes the advantage that it makes the adjustment easier for the user.

Independent if only a single or a double zoom wheel is used for the length adjustment it is according to the present invention preferred that the adjustor handle(s) (zoom wheel (s)) is/are adapted to be rotatable in a stepwise manner to enable a stepwise adjustment of the position of the moveable blade and/or the comb attachment, preferably enabling adjustment steps of 0.3 mm. Adjustment steps of 0.3 mm in this case mean that the hair cut length may be adjusted in steps of 0.3 mm. Of course also other adjustment step sizes are possible.

According to a further embodiment of the present invention, said adjustment unit further comprises a carriage element arranged on the stationary blade which is releasably connected to the slider and linked to the moveable blade, wherein a movement of the slider causes a movement of the carriage element and this again causes a movement of the moveable blade in said first adjustment direction.

Said carriage element is used to translate the movement of the slider which moves in a slider direction that is preferably arranged substantially or nearly parallel to the longitudinal axis of the housing, into a translational movement of the movable blade in the first adjustment direction. This movement transmission may be implemented in different ways. According to one embodiment, the movement transmission may be implemented by a tilting movement of the carriage element. The carriage element may thereto be fixated on the stationary blade and tiltable about its main axis that is substantially parallel to the toothed edge, wherein a movement of the slider causes the carriage element to tilt about its main axis, thereby causing a translational movement of the movable blade in said first adjustment direction.

Another way of implementing the above-mentioned movement transition is to guide the carriage element in a respective guidance on the stationary blade in order to be movable in the first adjustment direction, wherein the carriage element comprises an inclined surface which is resiliently biased against a corresponding inclined surface of the slider, so that a movement of the slider is due to the inclined surfaces translated into a translational movement of the carriage element in the first adjustment direction. Said translational movement of the carriage element again causes a translational movement of the movable blade to which it is attached. In contrast to the above-mentioned tilting setting of the carriage element this sliding carriage system is easier to implement and mechanically more robust. Similar as explained above, the sliding carriage setting may also be combined with the double zoom wheel system to enable two individual sliders for a separate adjustment of the comb and the tip-to-tip system.

According to a further embodiment of the present invention, the guidance in which the carriage element is guided on the stationary blade comprises an end stop element blocking the translational movement, so that the distance between the toothed edge and the front edge, seen in the first adjustment direction, may not become smaller than a predefined distance, preferably not smaller than 0.3 mm. This end stop element may, for example, be realized as a simple vertical wall that is arranged at the guidance's front end. It ensures that the tip-to-tip distance does not become smaller than the preferred smallest distance. Especially in case where a comb attachment is used to push the carriage element together with the movable blade in its foremost position in the above-mentioned way, said end stop element ensures a correct and exact positioning of the movable blade.

According to a further embodiment, the carriage element is connected to the movable blade via a spring element pressing the movable blade against said upper surface of the stationary blade, and wherein the spring element is adapted to press the carriage element towards the slider to maintain said releasable connection.

The mentioned spring element mainly has the function to deliver a so-called teeth pressure with which the toothed edge of the movable blade is pressed against the stationary blade. It is to be noted that also the front edge of the stationary blade is preferably toothed having a plurality of cutting teeth. The said teeth pressure ensures a good cutting performance and an exact positioning of the movable blade with respect to the stationary blade.

The second function of said spring element is to press the carriage element towards the slider. The spring force in this case ensures that the tip-to-tip setting returns to the corresponding zoom wheel setting when the comb is removed. In other words, the movable blade automatically flips back to the adjusted position of the adjustor handle as soon as the comb attachment is released from the clipping device. After removing the comb attachment a user may thus directly use the clipping device without comb, wherein the tip-to-tip setting directly follows the adjustment of the adjustment unit without further necessary steps.

The present invention furthermore relates to a hair clipping system, with a hair clipping device that comprises:

a housing;

a cutting assembly which is arranged on one end of said housing and comprises a stationary blade with a front edge and a moveable blade with a toothed edge arranged parallel to said front edge of the stationary blade, wherein the moveable blade is displaceably mounted on a surface of the stationary blade and resiliently biased against said surface of the stationary blade;

a driving arrangement for driving said moveable blade in an oscillatory movement in a transverse direction substantially parallel to the front edge of the stationary blade;

an adjustment unit for adjusting the position of the moveable blade with respect to the stationary blade in a first adjustment direction substantially perpendicular to said transverse direction; and with an additional attachment that can be releasably attached to the hair clipping device on a side of the stationary blade facing away from said surface of said stationary blade;

wherein said attachment comprises a blocking element that is adapted to block the adjustment of the position of the moveable blade with the adjustment unit and to push the moveable blade to a predefined position with respect to the stationary blade in the first adjustment direction, if said attachment is attached to the hair clipping device.

This embodiment of the presented hair clipping system makes separate use of the above-mentioned disconnecting option that overrules the positioning of the movable blade with respect to the stationary blade (tip-to-tip setting) when an additional attachment is attached, wherein said attachment pushes the movable blade to a predefined, preferred position.

In contrast to the embodiment of the hair clipping system mentioned initially, this embodiment also allows to use static comb attachments that are not adjustable by the above-mentioned adjustment unit, wherein these static comb attachments may also comprise the above-mentioned blocking element that releases the connection of the adjustment unit with the movable blade and pushes the movable blade to its predefined position as soon as the comb is attached to the hair clipping device.

This means that the presented technical principle of releasing the adjustment connection between the adjustment unit and the movable blade and pushing the movable blade to its predefined, preferred position also works without an adjustable comb attachment that may be adjusted with the adjustment unit (e.g. using the above-mentioned zoom wheel), simply using a static comb attachment. In the same way this technical principle may also be used for attachments other than combs. For example also a light attachment could be used. Said light attachment could, for example, be a flash light or a laser light that may be used as an optical indication of where it is currently being cut. The blocking element ensures that the tip-to-tip is always in its preferred position serving for optimal cutting performance as soon as the additional attachment is attached to the clipping device.

However, it is to be understood that depending on the type of attachment said predefined, preferred position does not necessarily need to be a position where the moveable blade is in its foremost position. The preferred position may also be a position where the moveable blade is in its most backward position, serving for the longest possible hair cut. In general terms, the preferred position is the position of the moveable blade that serves for optimal cutting performance with respect to the attachment that is being used. Further, it has to be noted that also different preferred positions may be adapted per attachment.

It shall be understood that the hair clipping system as recited in any one or more independent claims may have similar and/or identical preferred embodiments as other independent claims and as defined in the dependent claims. The term "comb attachment" may in the wording of the dependent claims be replaced by the term "additional attachment".

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE DRAWINGS

Figure 1:
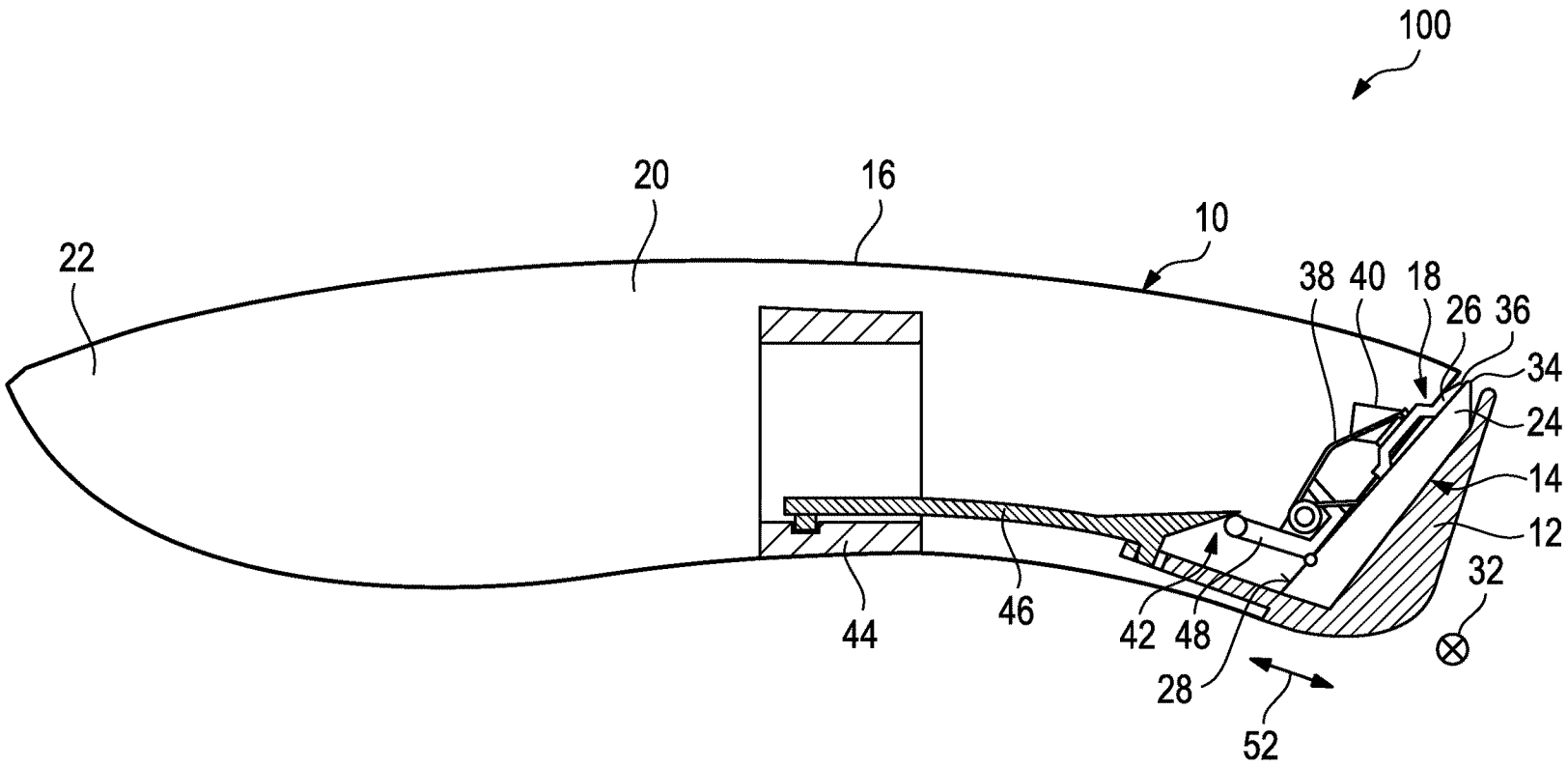
FIG. 1 illustrates the general design of a hair clipping systems according to the present invention in its entirety in a sectional view.

FIG. 1 schematically illustrates the principle design of a hair clipping system according to the present invention, which is in its entirety denoted with reference numeral 100. The hair clipping system 100 comprises a hair clipping device 10 and a comb attachment 12 that can be attached to a front or rear end 14 of the clipping device 10. The clipping device 10 comprises a housing 16 which connects all parts together and also serves as a skeleton for a cutting assembly 18. The housing 16 has an elongated body, wherein the cutting assembly 18 is realizably fixed to the front end 14, and which comprises a handle 20 at its rear end 22.

The outer surface of the elongated housing 16 is tapered outwardly from the rear end 22 to the front end 14 and has a slightly bent development to provide a more ergonomic holding position and to improve the esthetic appearance of the clipping device 10. It is to be noted that also other housing arrangements and designs are envisaged without leaving the scope of the invention.

An operating button (for simplicity reasons not shown) is provided on the housing 16 to operate the device 10, as will be explained hereinafter.

The cutting blade assembly 18 is removably mounted on the front end 14 of the housing 16. Said cutting assembly 18 may thus easily be removed which increases the cleanability of the cutting assembly 18 and thus improves the user friendliness. The cutting assembly 18 includes a stationary blade 24 and a movable blade 26. The movable blade 26 is displaceably mounted on an upper surface 28 of the stationary blade 24 which upper surface 28 faces substantially towards the inner side of the housing 16. A driving arrangement 30 including a motor (shown in FIG. 9) is adapted to drive the movable blade 18 in an oscillatory movement in a transverse direction 32 parallel to the front edge 34 of the stationary blade 24. A driving bridge 40 is used as a coupling element coupling the motor to the movable blade 26 and translating the motor movement to a translational/reciprocal movement in transverse direction 32.

The movable blade 26 comprises a toothed edge 36 with an array of teeth that is arranged substantially parallel to the front edge 34 of the stationary blade 24. During operation hair cutting is performed due to the interaction of the stationary blade 24 and the movable blade 26 that reciprocates in the transverse direction 32 as this is known from other conventional hair clipping devices.

The stationary blade 24 is usually designed to be thicker than the movable blade 26. Said stationary blade 24 is also denoted as guard 24. Its front edge 34 may either be designed as a sharp continuous edge or, similar as the movable blade 26, as a toothed edge with an array of cutting teeth. In order to receive a good cutting performance the movable blade 26 is actively pressed to the upper surface 28 of the stationary blade 24 to receive a so-called teeth pressure. A spring 38 is usually used to supply said teeth pressure by resiliently biasing the movable blade 26 against the upper surface 28 of the stationary blade 24.

The already mentioned comb attachment 12 is releasably attachable to the front end 14 of the housing 16. It can be fixed to the hair clipping device 10 via a comb interface that is usually realized by a simple holding fixture (not visible). The comb attachment 12 comprises a plurality of comb teeth 12' (exemplarily shown in FIGS. 14 C, D) that are adapted to at least partly surround the cutting assembly 18. The comb teeth 12' serve as spacers defining a gap between themselves and the cutting edge 36 of the movable blade 26.

The comb element 12 in other words spaces the cutting elements 24, 26 away from the surface of the hairy skin from which the hairs extend, to increase the length of the hair cut. At this point it shall be made clear that the term "hair cut length" denotes the length of the hairs that remain on the trimmed skin and not the length of the hair parts that are cut away. Further, it is to be noted that the comb attachment 12 can be of any design as long as it is mechanically attachable to the hair clipping device 10. The term "hair clipping system 100" includes the hair clipping device 10 and the comb attachment 12 (attached to the hair clipper 10 or not), while the hair clipping device 10 denotes the hair clipper itself without the comb attachment 12.

The hair clipping device 10 may also be used without the comb attachment 12, so that the cutting blade assembly 18 is exposed. This working mode especially allows for precise trimming of hair and leads to shorter haircut lengths, which may be particularly used for outer contours of the hairline or beard.

One of the main elements of the present invention relates to the special adjustment system for adjusting the position of the movable blade 26 and/or the position of the comb attachment 12. This special adjustment system is realized by an adjustment unit which is in its entirety denoted by reference numeral 42. The adjustment unit 42 comprises an adjustor handle 44, an adjustment element 46, also denoted as slider, a carriage element 48 and the spring 38.

The adjustment unit is on the one hand adapted to adjust the position of the movable blade 26 with respect to the stationary blade 24 in a first adjustment direction 50 (see FIGS. 10 to 12), which first adjustment direction 50 is substantially perpendicular to said transverse direction 32. On the other hand, the adjustment unit 42 is adapted to adjust the position of the comb attachment 12 with respect to the cutting assembly 18 in a second adjustment direction 52 if the comb attachment 12 is attached to the hair clipping device 10 (see FIGS. 1, 3 and 5). Said second adjustment direction 52 is arranged substantially perpendicular to the upper surface 28 of the stationary blade 24, so that the comb attachment may be moved away from the cutting assembly 18 in a substantially perpendicular direction thereto, thereby increasing the length of the hair cut.

In other words, the adjustment unit 42 may be used to adapt the position of the movable cutting blade 26 as well as to position the comb attachment 12 in corresponding, different adjustment directions 50, 52. Preferably, said first adjustment direction 50 is perpendicular to said transverse direction 32, and said second adjustment direction 52 is perpendicular to said upper surface 28 of the stationary blade 24. The working principle of said adjustment unit 42 will be explained in detail in the following.

Figure 2:
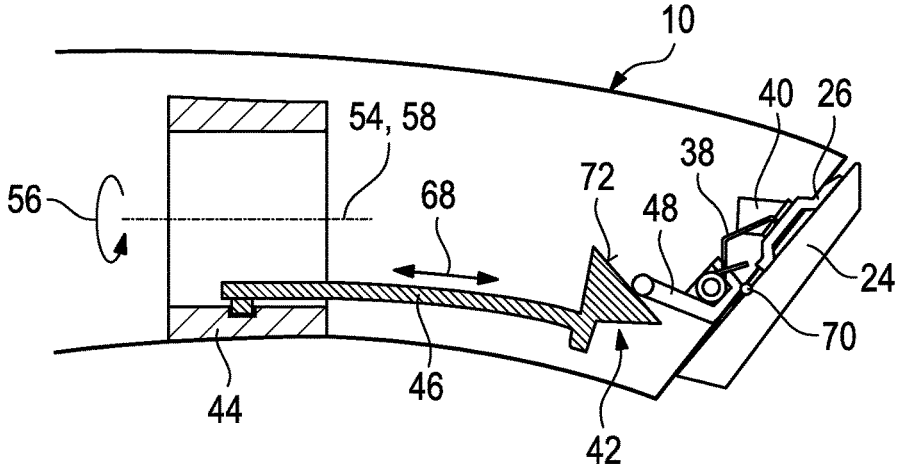
FIG. 2 illustrates a first embodiment of the hair clipping system according to the present invention without comb attachment.
Figure 3:
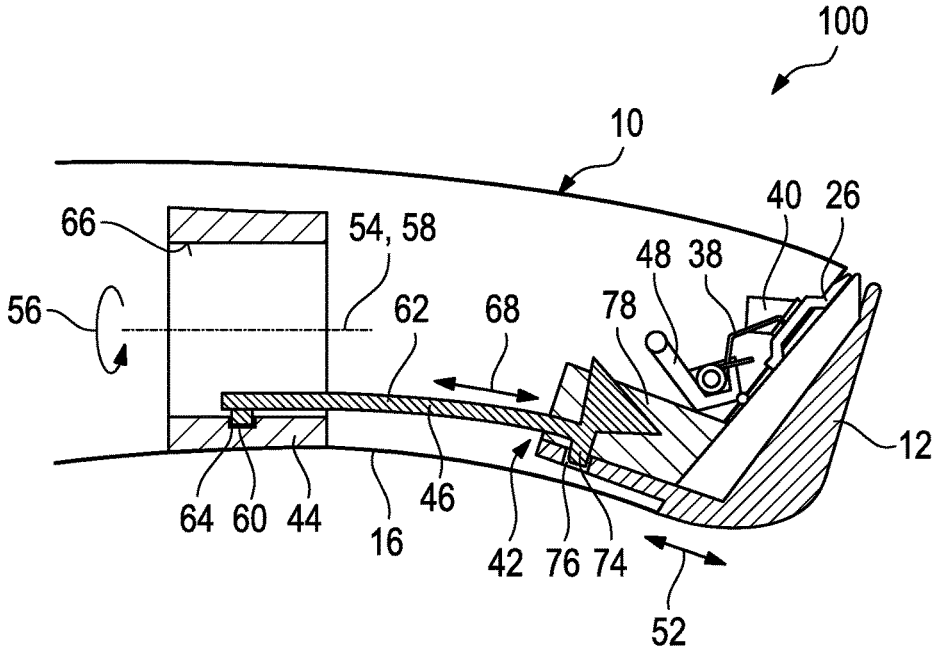
FIG. 3 illustrates the first embodiment shown in FIG. 2 with comb attachment.

According to the first embodiment illustrated in FIGS. 2 and 3 the adjustment unit 42 comprises an adjustor handle 44 which is rotatable around its central axis 54 in a rotation direction 56. Said central axis 54 is preferably aligned substantially parallel to a longitudinal axis 58 of the housing 16. It is to be noted that, in case the housing 16 is bent in the shown manner the longitudinal axis 58 thus denotes the middle axis of the housing 16 at the position where the adjustor handle 44 is arranged. The adjustor handle 44 can, of course, be arranged at variable positions within or on the housing 16. It could, for example, also be arranged at the very rear end 22 of the housing 16. Due to its design as a rotationally symmetric wheel the adjustor handle 44 is in practice also denoted as zoom wheel 44.

As it can be seen from FIGS. 2 and 3 the slider 46 is mechanically coupled to the zoom wheel 44. This connection can, for example, be realized by a coupling element 60 that protrudes from the elongated arm 62 of the slider 46, which coupling element 60 is mechanically guided in a corresponding guidance within the inner surface of the zoom wheel 44. Said guidance 64 may, in a top view, be inclined with respect to the central axis 54, i.e. spirally or helically developing within the inner surface 66 of the hollow zoom wheel 44.

In this way a rotational movement about the central axis 54 of the adjustor handle/zoom wheel 44 causes a movement of the slider 46 in a slider direction 68, i.e. along the longitudinal direction of the elongated arm 62 of the slider 46. In other words, the zoom wheel 44 translates a rotational movement (in rotation direction 56) into an effectively translational movement of the slider 46 (in slider direction 68). It is to be noted that the term "effectively" is used to denote that the slider 46 is effectively moved translationally in slider direction 68, wherein it is at the same time also rotated together with the zoom wheel 44 in rotation direction 56.

The described movement of the slider 46 in turn causes a movement of the movable blade 26 in the first adjustment direction 50 if the comb attachment 12 is not attached to the clipping device 10 as shown in FIG. 2. The translation of the slider movement in slider direction 68 to the movement of the movable blade 26 along the first adjustment direction 50 is realized by the carriage element 48 which is on one side connected to the slider 46 and on another side connected to the movable blade 26 via the already described spring 38.

According to the first shown embodiment (shown in FIGS. 2 and 3) the carriage element 48 is thereto tiltably fixed on the stationary blade/guard 28 with a fixation 70. The spring 38, on the one hand, presses the movable blade 26 against the upper surface 28 of the guard 24 and, on the other hand, presses the tiltable carriage element 48 on an inclined surface 72 of the slider 46. It is to be noted that the spring 38 does not necessarily need to be directly connected to the movable blade 26, but can also be connected to the driving bridge 40. The latter indirect connection is preferred in practice.

Figure 10:
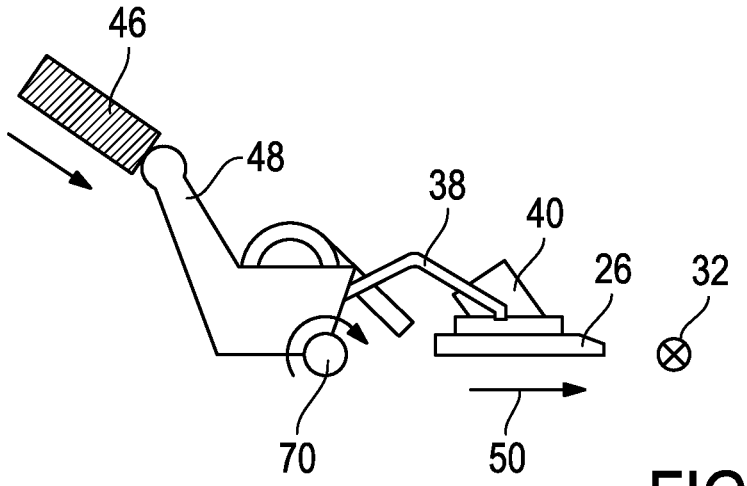
FIG. 10 schematically illustrates the principle of adjusting the movable blade of the hair clipping system according to the first and third embodiment.
Figure 11:
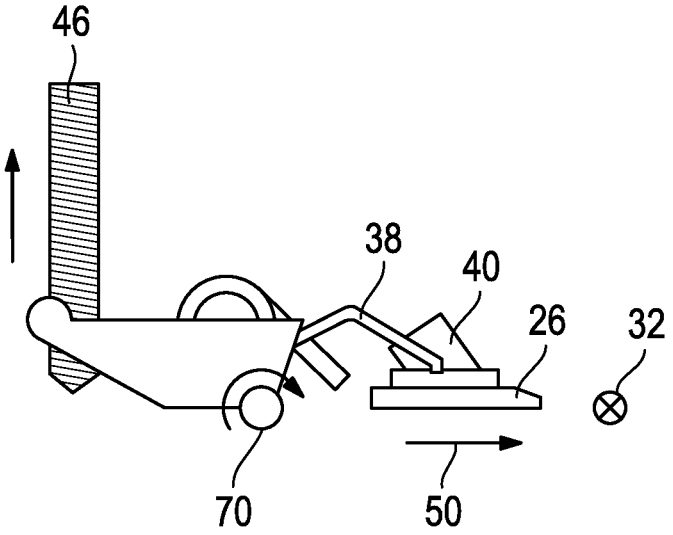
FIG. 11 schematically illustrates the principle of adjusting the movable blade of the hair clipping system according to the second embodiment.

As schematically shown in FIG. 10 the movement of the slider 46, due to the inclined surface 72, causes the carriage element 48 to tilt about its fixation point 70 that falls together with its tilt or main axis. The tilt of the carriage element 48 again forces the movable blade 26 in the first adjustment direction 50 towards the front edge 34 of the guard 24 thereby decreasing the resulting hair cut length. The proposed adjustment thus allows a user to easily adjust the position of the movable blade 26 in the first adjustment direction 50.

The therewith adjusted distance between the toothed edge 36 of the movable cutting blade 26 and the front edge 34 of the stationary cutting blade 24 is also denoted as tip-to-tip adjustment or tip-to-tip distance, respectively. This technical term abbreviates the distance of the tip portion of the movable blade 26 to the tip portion of the stationary blade or guard 24.

In a practical appliance of the present invention said tip-to-tip distance is preferably adjustable between 0.3 mm and 2 mm, with a step size of 0.3 mm. Of course, also other step sizes are technically possible, as well as a continuous, stepless adjustment. To ease the usage for the user a corresponding distance scale (not shown) may be visibly marked on the outer body of the housing 16 next to the zoom wheel 44.

As already explained above, the same adjustment unit 42 can also be used to adjust the position of the comb attachment 12 if the comb attachment is attached to the hair clipping device 10 as shown in FIG. 3. The comb attachment 12 may thereto connect to the slider 46 when being attached to the front end 14 of the hair clipper 10. Such a connection is, for example, realized by a further coupling element 74 that automatically clips into a corresponding groove 76 within the comb attachment 12 when attaching the comb attachment 12 to the hair clipping device 10. In this way the above-described rotational movement of the zoom wheel 44 causes a movement of the slider 46 in the above-mentioned slider direction 68 which in turn causes a movement of the comb attachment 12 in the second adjustment direction 52. Thereby, the user may easily adjust the hair cut length using the same zoom wheel 44 as before. A rotation in rotation direction 56 then forces the comb attachment to move away from the blade assembly 18, thereby increasing the realized hair cut length.

Figure 12:
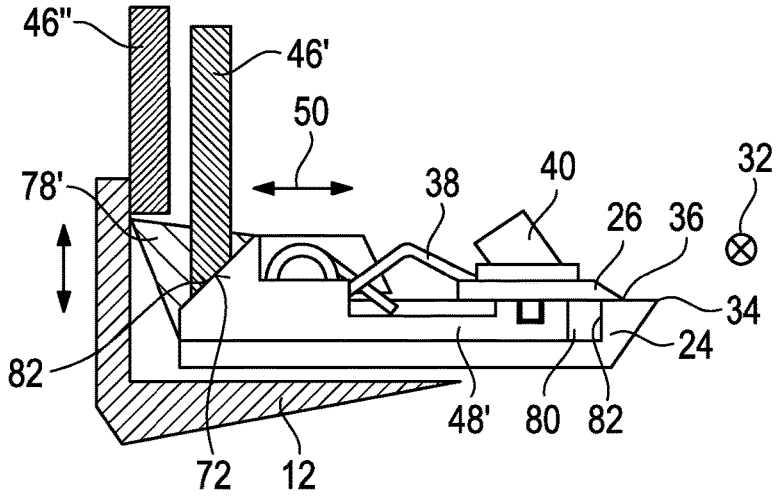
FIG. 12 schematically illustrates the principle of adjusting the movable blade of the hair clipping system according to the fourth embodiment.

When studying FIG. 3 in detail it can be seen that the comb attachment 12 additionally comprises a so-called blocking element 78 that protrudes towards the inner side of the housing 16 and decouples the carriage element 48 from the slider 46, i.e. releasing the connection between the inclined surface 72 of the slider 46 and the carriage element 48. The blocking element 78 may be realized in many ways. The easiest way of realization is to design the blocking element as a protruding housing part of the comb attachment 12 that is adapted to push the carriage element 48 away from the slider 46 to thereby block the movable blade adjustment. However, also more complicated arrangements are generally conceivable. Furthermore, it is to be noted that the blocking element 78 does not necessarily need to be arranged on the comb attachment 12. As schematically shown in FIG. 12, a blocking element 78' may in the same way also be a part of the carriage element 48.

Said blocking element 78 does, according to the described first embodiment (FIGS. 2 and 3), not only decouple the connection between the slider 46 and the carriage element 48, but also pushes the movable blade 26 to a predefined position with respect to the guard/stationary blade 24. The therewith enabled movement of the movable blade 26 leads to the following advantages.

Attaching the comb attachment 12 automatically increases the difficulty to cut hair. In other words, the hairs will have difficulties to enter further into the system reaching the cutting assembly 18 due to obstacles, such as the comb teeth and the distance to be traveled to the cutting assembly 18. Said difficulty increases when increasing the desired hair cut length, i.e. increasing the distance of the comb teeth to the cutting assembly 18. If said distance to travel to the cutting assembly 18 is too large, no cutting will occur, or in the best case a bad cutting performance is reached.

However, this is overcome by mechanically and automatically releasing the connection of the adjustment unit 42 to the movable cutting blade 26 and pushing the movable cutting blade 26 to the predefined preferred position as mentioned above. Said predefined position of the movable cutting blade 26 is a position where the toothed edge 36 of the movable cutting blade 26 is, seen in the first adjustment direction 50, in its foremost position with respect to the front edge 34 of the guard 24. In other words, the predefined preferred position is a position in which the tip-to-tip distance is as small as possible. According to the present invention it is in this case preferred to have a tip-to-tip distance of less than 0.6 mm, more preferably of 0.3 mm, or even less.

Since the above-mentioned spring 38 resiliently presses the carriage element 48 against the inclined surface 72 of the slider 46, the spring 38 will force the carriage element 48 to flip back against the inclined surface 72 when the comb attachment 12 is released from the clipping device 10 and the blocking element 78 does no longer push the carriage element 48 to its foremost position. This guarantees that the movable cutting blade 26 always flips back to the position that is set by the zoom wheel 44 when the comb attachment 12 is released.

In summary, the above-described arrangement allows for the best haircutting performance when using the comb attachment 12 independent of its position, since the tip-to-tip is always kept as small as possible. A user may thus use the clipping device 10 in connection with the comb attachment 12 to variably adjust for hair cutting lengths between, for example, 2.5 mm and 10 mm without loosing cutting performance. Similarly as the position adjustment of the movable cutting blade 26 the adjustment of the comb attachment 12 may also either be a stepless or a stepwise adjustment. In practice, step sizes of 0.3 or 0.5 mm seem to be reasonable. Also similar as explained above a second length scale may be marked on the housing 16 for giving the user a feedback of the currently adjusted hair cut length with the comb 12.

By comparing FIGS. 2 and 3 it can be seen that a rotation of the zoom wheel 44 in rotation direction 56, according to this embodiment, leads to different adjustment situations. While rotating the zoom wheel 44 in rotation direction 56 leads to a smaller tip-to-tip distance, i.e. to a shorter haircut (if no comb 12 is attached), a rotation in the same direction 56 leads to a larger distance of the comb teeth to the cutting blade assembly 18, i.e. to a longer hair cut (if the comb 12 is attached). This might confuse the user, since the zoom wheel 44 has once to be moved in one direction to decrease the hair cut length when no comb 12 is attached, while the other time the user has to move the zoom wheel 44 in the other, opposite direction to decrease the haircut length if a comb 12 is attached.

Figure 4:
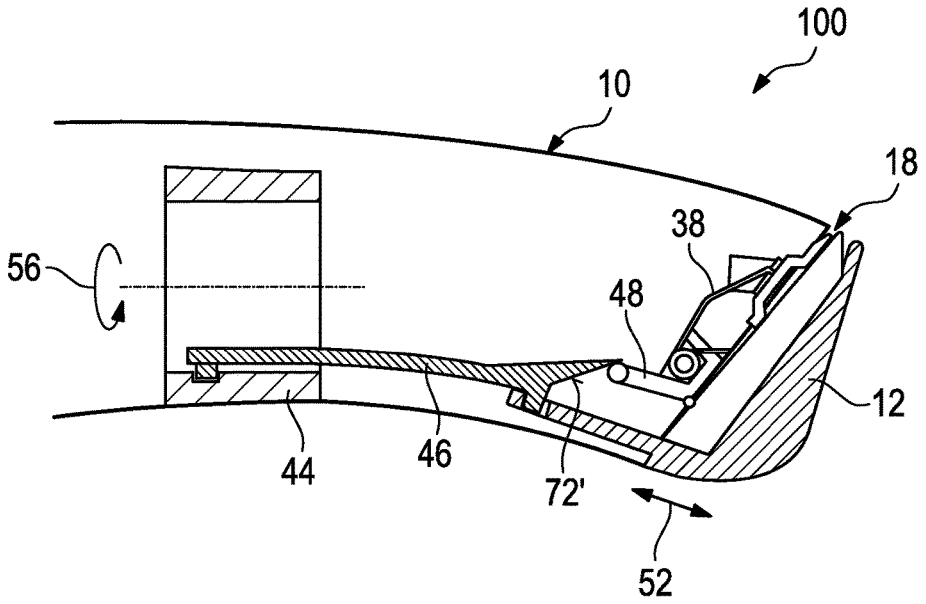
FIG. 4 illustrates a second embodiment of the hair clipping system according to the present invention with comb attachment in a first position.
Figure 5:
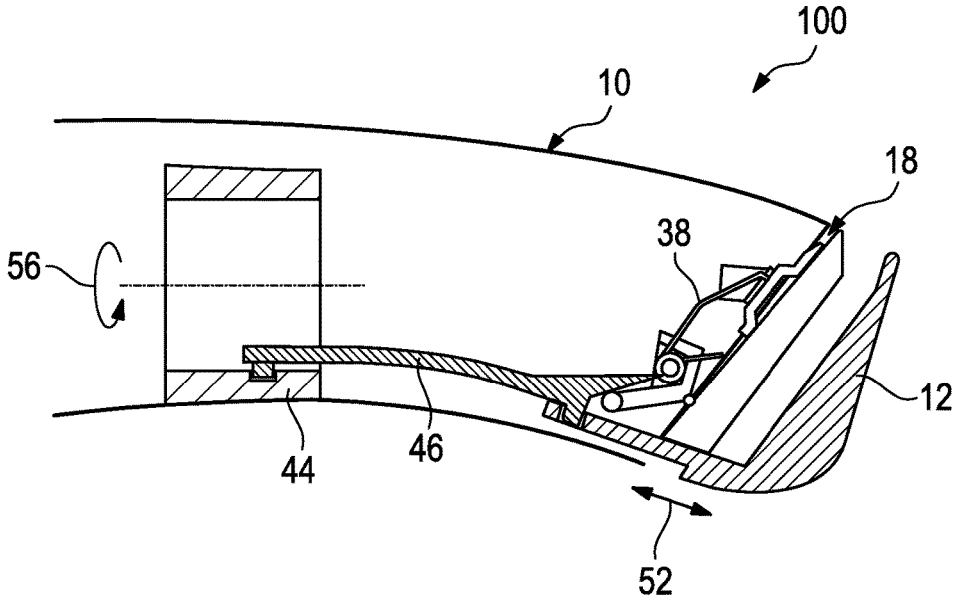
FIG. 5 illustrates the second embodiment shown in FIG. 4 with comb attachment in a second position.

This is not the case in the second embodiment illustrated in FIGS. 4 and 5. While all other parts of the clipping device 10 basically remain the same as in the first embodiment, the slider 46 and its arrangement with respect to the carriage element 48 is slightly modified. The inclined surface 72' is according to the second embodiment inversely inclined and arranged on the other side of the carriage element 48. The spring 38 in this case pushes the carriage element 48 against the inclined surface 72' from the opposite direction compared to the first embodiment (compared to FIGS. 2 and 3). In other words, the spring force of the spring 38 now pulls the carriage element 48 against the inclined surface 72', whereas it pushes the carriage element 48 against the inclined surface 72 in the first embodiment.

This modification leads to the situation that a turning of the zoom wheel 44 in rotation direction 56 increases the tip-to-tip distance and at the same time also increases the distance of the comb attachment 12 to the blade assembly 18, both leading to an increase of the hair cut length. A confusion of the user as mentioned above thus no longer occurs.

However, this solution does not allow the comb attachment 12 or the carriage element 46 to comprise a blocking element 78 as presented with respect to the first embodiment. Attaching the comb 12 to the clipping device 10 does therefore not release the connection of the adjustment unit 42 to the movable cutting blade 24 and push the movable cutting blade 24 to its preferred position (smallest tip-to-tip distance). The adjustment principle of the so-called pull-back system of the second embodiment is schematically illustrated in detail in FIG. 11.

Figure 6:
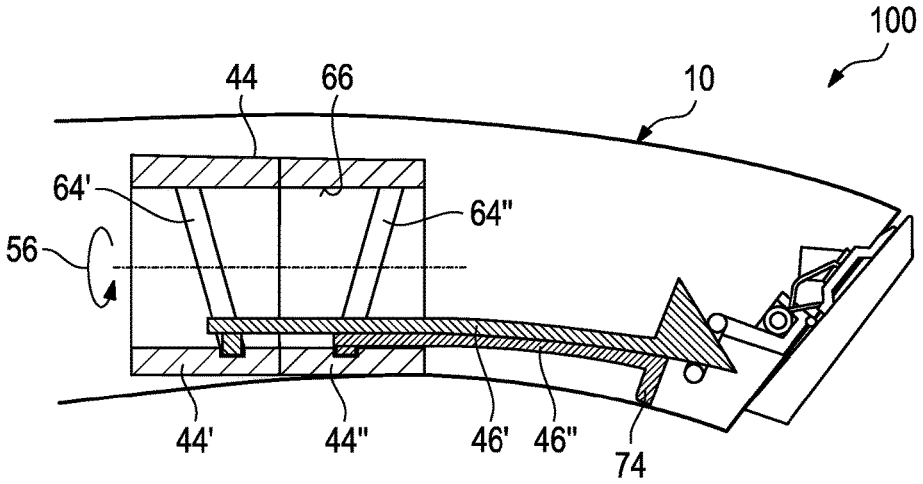
FIG. 6 illustrates a third embodiment of the hair clipping system according to the present invention without comb attachment.
Figure 7:
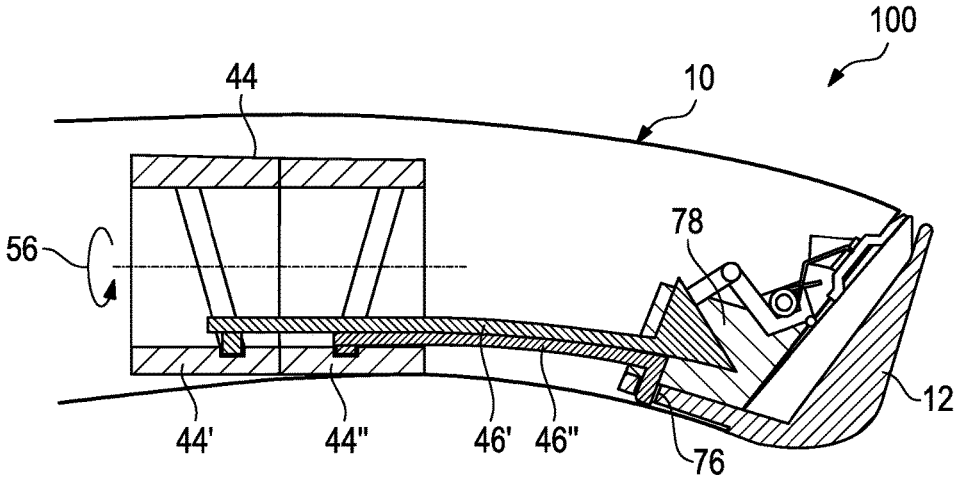
FIG. 7 illustrates the third embodiment shown in FIG. 6 with comb attachment.

The above-mentioned technical principles and their accompanying advantages are combined and fulfilled within the third embodiment shown in FIGS. 6 and 7. Therein the adjustment unit 42 comprises two independent adjustment elements 46', 46" which in the following will be referred to as blade slider 46' and comb slider 46". The first adjustment element 46', the blade slider, is adapted for adjusting the position of the movable blade 26 in the first adjustment direction 50 in the same way as explained with reference to the first embodiment (FIGS. 2, 3). The second adjustment element 46", comb slider, is adapted to adjust the position of the comb attachment 12 via the coupling element 74 and the corresponding groove 76 within the comb attachment 12.

The adjustor handle 44 is also modified and comprises two independent adjustor handles 44', 44" which are in the following also denoted as zoom wheels 44', 44". The blade zoom wheel 44' is connected to the movable cutting blade 26 via the blade slider 46' and the comb zoom wheel 44" is connected to the comb attachment 12 via the comb slider 46". The guidances 64', 64" within the inner surface 66 of the zoom wheels 44', 44" again have a spiral or helical development along the inner surface 66. However, the guidances 64', 64" are inclined in opposite directions, i.e. the helical development of the guidances 64', 64" are oppositely arranged to each other.

The two described independent zoom wheel arrangements thus allow the user to rotate each zoom wheel 44', 44" in the same direction, wherein rotating the zoom wheels 44', 44" in rotation direction 56 in both cases lead to a larger cutting length, independent if the comb 12 is attached or not. A rotation in rotation direction 56 increases the tip-to-tip distance when using zoom wheel 44' and no comb 12 is attached, and increases the distance of the comb teeth to the cutting blade assembly 18 in case the comb is attached to the hair clipping device. Providing the comb attachment 12 with the blocking element 78 also enables to decouple the movable cutting blade 26 from the adjustment unit 42, thereby blocking the cutting blade adjustment, if the comb 12 is attached.

It is to be noted that the zoom wheel 44 is shown in FIGS. 6 and 7 as two individual zoom wheels, but it could also be only a single zoom wheel 44 that is connected to the movable cutting blade 26 via a blade slider 46' and to the comb attachment 12 via a comb slider 46" (in case a comb is attached). The technical principle remains the same, i.e. by providing two guidances 64', 64" that are oppositely arranged to each other, so that rotating the zoom wheel 44 in rotation direction 56 in both cases (comb attached or not) leads to a larger cutting length, independent if the comb 12 is attached or not. Using only one zoom wheel furthermore includes the advantage that it makes the adjustment easier for the user.

Figure 8:
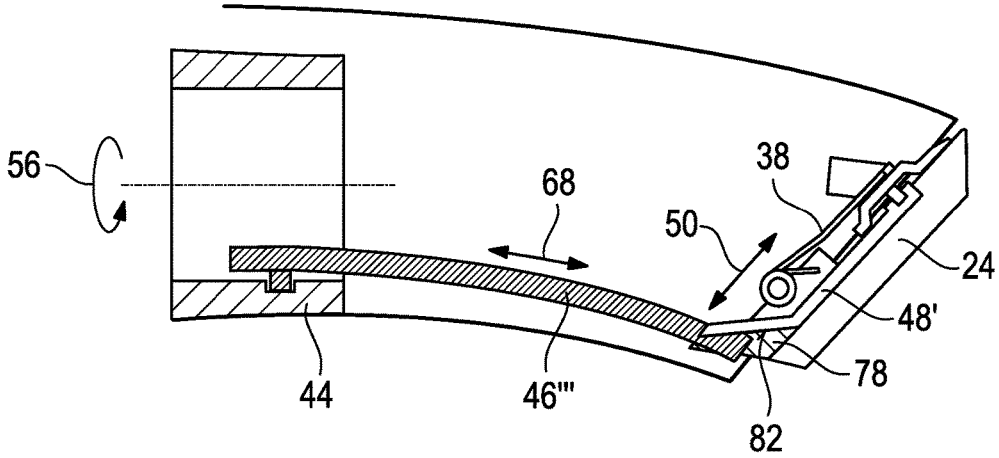
FIG. 8 illustrates a fourth embodiment of the hair clipping system according to the present invention without comb attachment.
Figure 9:
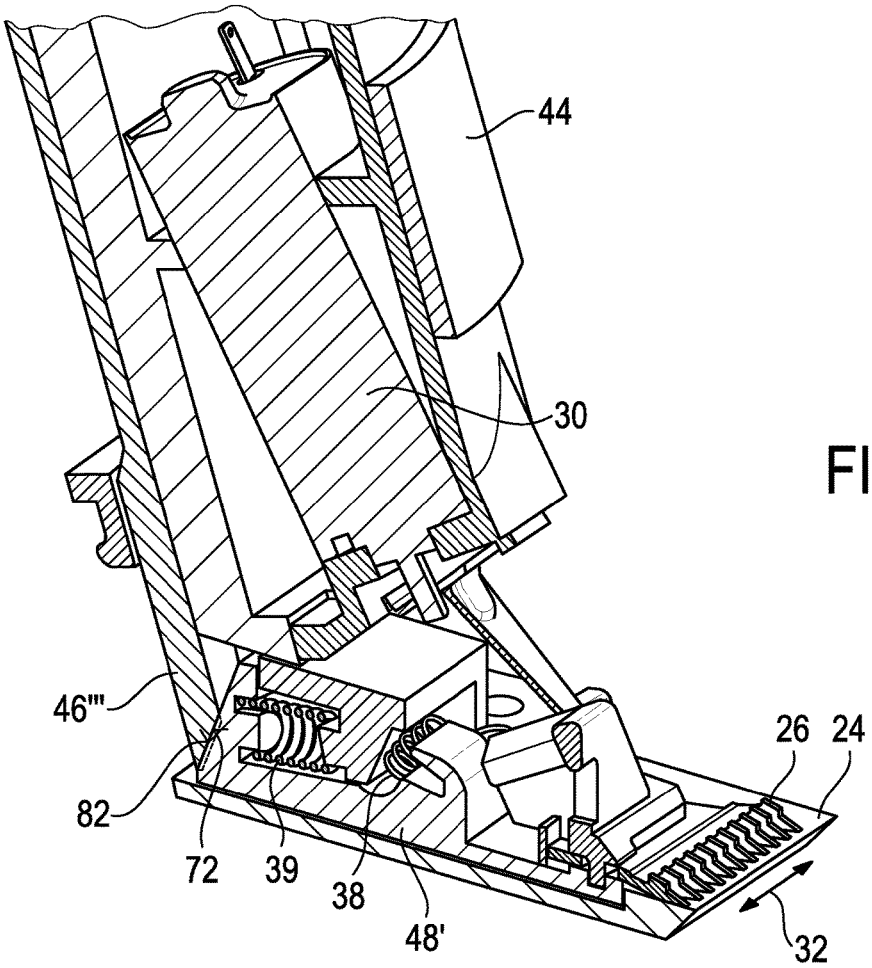
FIG. 9 shows a perspective view illustrating the parts of the hair clipping system according to the fourth embodiment shown in FIG. 8.

A fourth embodiment of the present invention is shown in FIGS. 8 and 9. While most of the other parts remain the same as explained before, the carriage element 48' is according to the force embodiment slidely modified. In contrast to the first three embodiments mentioned before, the carriage element 48' is no longer tiltably mounted on the guard 24. Instead, the carriage element 48' is now slidable along the first adjustment direction 50. The carriage element 48' is there to preferably guided in a guidance 80 on the stationary cutting blade/guard 24, which can be seen in detail in the drawing shown in FIG. 12. In order to translate the movement of the slider 46 into a translational movement of the carriage element 48', the carriage element 48' comprises at its rear end an inclined surface 82 which is resiliently biased against the already described inclined surface 72 of the slider 46. Instead of tilting the carriage element 48 the carriage element is in this way slidable within the guidance 80, and a movement in adjustment direction 50 is activated via the two mating inclined surfaces 72, 82.

Through this connection the carriage element 48' and the slider 46 are releasably connected with each other again. As it can be seen from FIG. 9 an additional spring 39 needs to be provided in order to bias the carriage element 48' against the inclined surface 72 of the slider 46. The additional spring 39 is thereto arranged parallel to the first adjustment direction 50 so that its spring force is also effective in said direction 50.

The reason why there is a need for an additional spring 39, is that the spring force of the first spring 38 is, according to this embodiment, only effective perpendicular to the upper surface 28 of the guard 24 (perpendicular to the first adjustment direction 50) in order to press the movable cutting blade 26 against the guard and provide the above-mentioned teeth pressure.

Similar as in the first and third embodiment the adjustment of the movable cutting blade 26 may be decoupled if a comb 12 is attached to the hair clipping device 10. The blocking element 78 which decouples the connection between the slider 46 and the carriage element 48' may either be arranged at a protruding housing part of the comb attachment (as explained according to the first and third embodiment) or arranged at the rear end of the carriage element 48' (as this is schematically shown in FIG. 12). Therein, the similar blocking element is denoted with reference numeral 78'.

As it can be further seen from FIG. 12 two independent sliders 46', 46" are used to adapt the position of the carriage element 48' and the comb attachment 12. The technical principle and the accompanying advantages are the same as explained before with reference to the third embodiment. However, it has to be understood that also an integral slider 46 may be used in this embodiment which is adapted to position the movable cutting blade 26 as well as the comb attachment 12 (as explained above with reference to the first embodiment).

Figure 13:
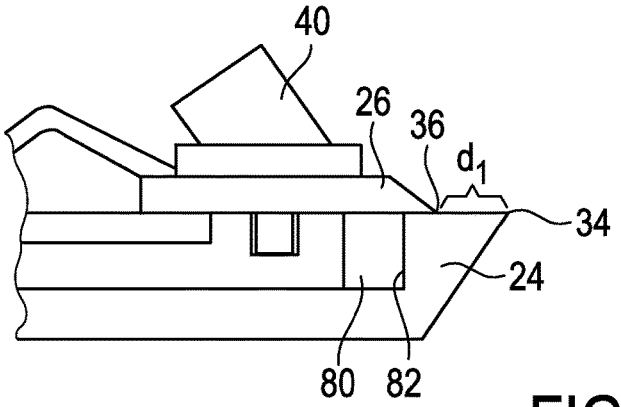
FIG. 13 shows an enlarged view of FIG. 12.
Figure 14A:
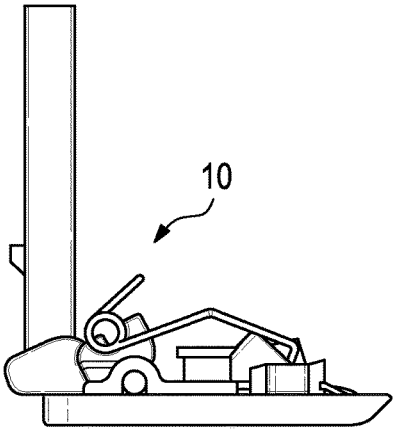
FIGS. 14 A-D illustrate the adjustment of the movable blade and the comb attachment in different positions.
Figure 14B:
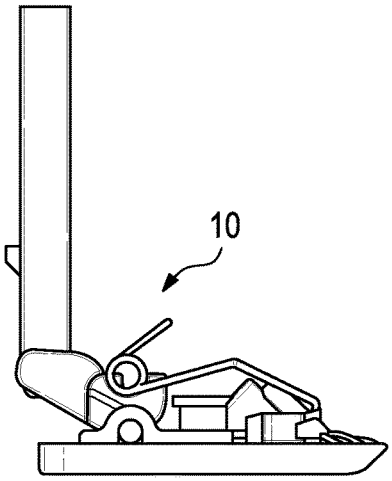
Figure 14C:
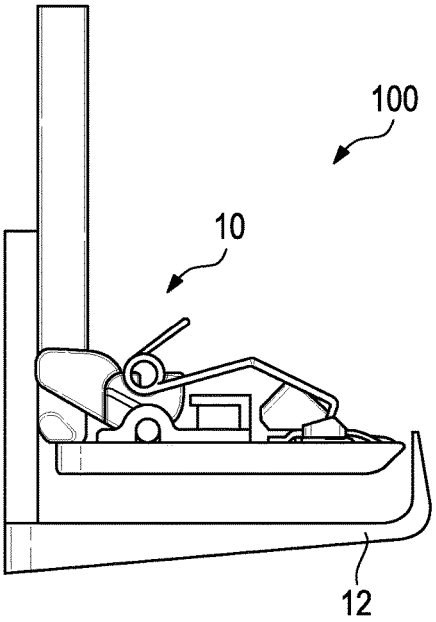
Figure 14D:
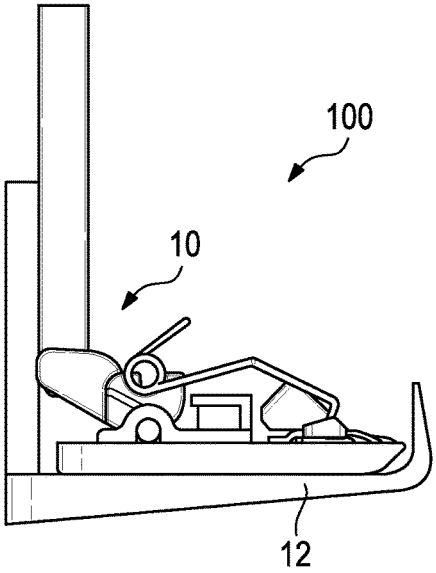

FIG. 13 also corresponds to the fourth embodiment and shows an enlarged view of the front end of the cutting assembly 18 shown in FIG. 12. Therein, it can be seen that the guidance 80 also comprises an end stop element 82 that is designed as a simple vertical wall and which is adapted to block the translational movement of the carriage element 48' at a predefined position. Preferably said predefined position defines the foremost position of the movable cutting blade, so that the end stop element 82 avoids that the distance $d_1$ between the toothed edge 36 of the movable cutting blade 26 and the front edge 34 of the guard 24 becomes too small, e.g. smaller than 0.3 mm.

FIG. 14 summarizes the technical principle of the present invention and shows the hair clipping device 10 in the different above-explained working positions with and without comb attachment 12. In FIG. 14A the movable cutting blade 26 is in its very back position which corresponds to the longest tip-to-tip setting, and depending on the specific design, results in a haircut length between 2 to 4 mm. In FIG. 14B the movable cutting blade 26 is in its foremost position, which corresponds to the shortest tip-to-tip setting, leading to a haircut length of around 0.3 mm. In FIGS. 14C and D the comb attachment 12 is attached to the hair clipping device 10 and the adjustment of the movable blade is overridden or decoupled, wherein the tip-to-tip setting is arranged to be the shortest, i.e. the movable cutting blade is automatically moved to its foremost position. While FIG. 14C shows the longest comb setting (largest distance between comb 12 and cutting assembly 18) leading to a haircut length of around 10 mm, FIG. 14D shows the shortest comb setting (shortest distance between comb 12 and cutting assembly 18) leading to a haircut length of around 2 to 5 mm (depending on the specific design).

In summary the present invention provides a smart solution to adjust the tip-to-tip distance and the comb attachment of a trimming device simultaneously. On the one hand, the tip-to-tip system may be used to create different hair cut lengths by adapting the position of a movable cutting blade with respect to a stationary guard blade. In addition the presented solution also allows to adjust the position of a comb attachment with the same adjustment unit. Due to the specific technical design of the presented solution the movable cutting blade may be automatically moved to its foremost position as soon as a comb attachment is attached to the trimming device. This ensures the best cutting performance with respect to hair catching also in situations where a comb is attached to the hair trimmer. In these cases the presented system also allows to automatically decouple and block the adjustment unit of the movable cutting blade.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A hair clipping system with a hair clipping device that comprises:

a housing;

a cutting assembly arranged on one end of said housing and comprising a stationary blade with a front edge and a moveable blade with a toothed edge arranged parallel to said front edge of the stationary blade, wherein the stationary blade is fixedly mounted to the housing and the moveable blade is displaceably mounted on a surface of the stationary blade and resiliently biased against said surface of the stationary blade;

a drive arrangement configured to drive said moveable blade in an oscillatory movement in a transverse direction substantially parallel to the front edge of the stationary blade;

an adjustment unit configured to adjust a position of the moveable blade with respect to the stationary blade in a first adjustment direction substantially perpendicular to said transverse direction; and a comb attachment with a plurality of comb teeth that can be releasably attached to the hair clipping device on a side of the stationary blade facing away from said surface of said stationary blade to create an adjustable gap between the comb teeth and said cutting assembly, that are adapted to at least partly surround the cutting assembly, and the moveable blade, the comb attachment being a separate part from the stationary blade;

wherein the adjustment unit is further configured to adjust a position of the comb attachment with respect to said cutting assembly in a second adjustment direction substantially perpendicular to said surface of the stationary blade when the comb attachment is attached to the hair clipping device, wherein the comb attachment comprises a blocking element that is adapted to block the adjustment of the position of the moveable blade by the adjustment unit and to push the moveable blade to a predefined position along the first adjustment direction in response to the comb attachment being attached to the hair clipping device.

2. The hair clipping system according to claim 1, wherein the adjustment unit comprises a releasable connection with the moveable blade, wherein the adjustment unit is configured to adjust the position of the moveable blade in the first adjustment direction through the releasable connection, which releasable connection is mechanically released by the blocking element of the comb attachment, thereby blocking the adjustment of the position of the moveable blade by the adjustment unit when the comb attachment is attached to the hair clipping device.

3. A hair clipping system with a hair clipping device that comprises:

a housing;

a cutting assembly arranged on one end of said housing and comprising a stationary blade with a front edge and a moveable blade with a toothed edge arranged parallel to said front edge of the stationary blade, wherein the stationary blade is fixedly mounted to the housing and the moveable blade is displaceably mounted on a surface of the stationary blade and resiliently biased against said surface of the stationary blade;

a drive arrangement configured to drive said moveable blade in an oscillatory movement in a transverse direction substantially parallel to the front edge of the stationary blade;

an adjustment unit configured to adjust a position of the moveable blade with respect to the stationary blade in a first adjustment direction substantially perpendicular to said transverse direction; and a comb attachment with a plurality of comb teeth that can be releasably attached to the hair clipping device on a side of the stationary blade facing away from said surface of said stationary blade to create an adjustable gap between the comb teeth and said cutting assembly, that are adapted to at least partly surround the cutting assembly, and the moveable blade, the comb attachment being a separate part from the stationary blade;

wherein the adjustment unit is further configured to adjust a position of the comb attachment with respect to said cutting assembly in a second adjustment direction substantially perpendicular to said surface of the stationary blade when the comb attachment is attached to the hair clipping device, wherein the adjustment unit comprises an adjustor handle that is arranged one of on and within the housing of the clipping device, which adjustor handle is rotatable around its central axis, wherein a rotational movement of the adjustor handle causes a movement of a slider to which the adjustor handle is connected, wherein the slider is linked to the moveable blade so as to activate a movement of the moveable blade in the first adjustment direction in response to the rotational movement of the adjustor handle, and wherein the slider is releasably connected to the comb attachment activating a movement of the comb attachment in the second adjustment direction in response to the rotational movement of the adjustor handle when the comb attachment is attached to the hair clipping device.

4. The hair clipping system according to claim 3, wherein said adjustment unit comprises two independent adjustment elements, a first adjustment element configured to adjust the position of the moveable blade in said first adjustment direction, and a second adjustment element configured to adjust the position of said comb attachment in said second adjustment direction when the comb attachment is attached to the hair clipping device.

5. A hair clipping system with a hair clipping device that comprises:

a housing;

a cutting assembly arranged on one end of said housing and comprising a stationary blade with a front edge and a moveable blade with a toothed edge arranged parallel to said front edge of the stationary blade, wherein the stationary blade is fixedly mounted to the housing and the moveable blade is displaceably mounted on a surface of the stationary blade and resiliently biased against said surface of the stationary blade;

a drive arrangement configured to drive said moveable blade in an oscillatory movement in a transverse direction substantially parallel to the front edge of the stationary blade;

an adjustment unit configured to adjust a position of the moveable blade with respect to the stationary blade in a first adjustment direction substantially perpendicular to said transverse direction; and a comb attachment with a plurality of comb teeth that can be releasably attached to the hair clipping device on a side of the stationary blade facing away from said surface of said stationary blade to create an adjustable gap between the comb teeth and said cutting assembly, that are adapted to at least partly surround the cutting assembly, and the moveable blade, the comb attachment being a separate part from the stationary blade;

wherein the adjustment unit is further configured to adjust a position of the comb attachment with respect to said cutting assembly in a second adjustment direction substantially perpendicular to said surface of the stationary blade when the comb attachment is attached to the hair clipping device, wherein the adjustment unit comprises two independent adjustor handles that are arranged one of on and within the housing of the clipping device, which adjustor handles are rotatable around their common central axis, wherein a rotational movement of the first adjustor handle causes a movement of a first slider to which it is connected, wherein the first slider is linked to the moveable blade so as to activate a translational movement of the moveable blade in the first adjustment direction in response to the rotational movement of the first adjustor handle, and wherein a rotational movement of the second adjustor handle causes a movement of a second slider to which it is connected, wherein the second slider is connected to the comb attachment activating a movement of the comb attachment in the second adjustment direction in response to the rotational movement of the second adjustor handle when the comb attachment is attached to the clipping device.

6. A hair clipping system with a hair clipping device that comprises:

a housing;

a cutting assembly arranged on one end of said housing and comprising a stationary blade with a front edge and a moveable blade with a toothed edge arranged parallel to said front edge of the stationary blade, wherein the stationary blade is fixedly mounted to the housing and the moveable blade is displaceably mounted on a surface of the stationary blade and resiliently biased against said surface of the stationary blade;

a drive arrangement configured to drive said moveable blade in an oscillatory movement in a transverse direction substantially parallel to the front edge of the stationary blade;

an adjustment unit configured to adjust a position of the moveable blade with respect to the stationary blade in a first adjustment direction substantially perpendicular to said transverse direction; and a comb attachment with a plurality of comb teeth that can be releasably attached to the hair clipping device on a side of the stationary blade facing away from said surface of said stationary blade to create an adjustable gap between the comb teeth and said cutting assembly, that are adapted to at least partly surround the cutting assembly, and the moveable blade, the comb attachment being a separate part from the stationary blade;

wherein the adjustment unit is further configured to adjust a position of the comb attachment with respect to said cutting assembly in a second adjustment direction substantially perpendicular to said surface of the stationary blade when the comb attachment is attached to the hair clipping device, wherein said adjustment unit comprises two independent adjustment elements, a first adjustment element configured to adjust the position of the moveable blade in said first adjustment direction, and a second adjustment element configured to adjust the position of said comb attachment in said second adjustment direction when the comb attachment is attached to the hair clipping device, wherein said two independent adjustment elements are connected to a single adjustor handle, wherein activating the adjustor handle causes a movement of the first adjustment element which is linked to the moveable blade so as to activate a movement of the moveable blade in the first adjustment direction in response to the rotational movement of the adjustor handle, and wherein activating the adjustor handle causes a movement of the second adjustment element which is linked to the comb attachment so as to activate a movement of the comb attachment in the second adjustment direction in response to the rotational movement of the adjustor handle when the comb attachment is attached to the hair clipping device.

7. The hair clipping system according to claim 3, wherein the adjustor handle is adapted to be rotatable in a stepwise manner to enable a stepwise adjustment of the position of the moveable blade and/or the comb attachment.

8. The hair clipping system according to claim 3, wherein said adjustment unit further comprises a carriage element arranged on the stationary blade which is releasably connected to the slider and linked to the moveable blade, wherein a movement of the slider causes a movement of the carriage element which causes a movement of the moveable blade in said first adjustment direction.

9. The hair clipping system according to claim 8, wherein said carriage element is fixated on the stationary blade and is tiltable about its main axis that is substantially parallel to the toothed edge, wherein a movement of the slider causes the carriage element to tilt about its main axis, thereby causing a movement of the moveable blade in said first adjustment direction.

10. The hair clipping system according to claim 8, wherein said carriage element is guided in a guidance on the stationary blade to be moveable in the first adjustment direction, wherein the carriage element comprises an inclined surface which is resiliently biased against a corresponding inclined surface of the slider defining said releasable connection, so that a movement of the slider is translated into a translational movement of the carriage element in the first adjustment direction.

11. The hair clipping system according to claim 10, wherein said guidance comprises an end stop element blocking the translational movement, so that the distance between the toothed edge and the front edge may not become smaller than a predefined distance.

12. The hair clipping system according to claim 8, wherein said carriage element is connected to the moveable blade via a spring element pressing the moveable blade against said surface of the stationary blade, and wherein said spring element is adapted to press the carriage element towards the slider to maintain said releasable connection.

13. A hair clipping device for a hair clipping system, which hair clipping device comprises:

a housing;

a cutting assembly arranged on one end of said housing and comprising a stationary blade with a front edge and a moveable blade with a toothed edge arranged parallel to said front edge of the stationary blade, wherein the stationary blade is fixedly mounted to the housing and the moveable blade is displaceably mounted on a surface of the stationary blade and resiliently biased against said surface of the stationary blade;

a drive arrangement configured to drive said moveable blade in an oscillatory movement in a transverse direction substantially parallel to the front edge of the stationary blade;

an adjustment unit configured to adjust a position of the moveable blade with respect to the stationary blade in a first adjustment direction substantially perpendicular to said transverse direction; and a holding fixture configured to releasably attach an additional attachment comprising a comb attachment, the comb attachment being a separate part from the stationary blade, wherein the adjustment unit is further configured to adjust a position of said attachment with respect to said cutting assembly in a second adjustment direction substantially perpendicular to said surface of the stationary blade when the attachment is attached to the hair clipping device, wherein the adjustment unit comprises an adjustor handle that is arranged one of on and within the housing of the clipping device, which adjustor handle is rotatable around its central axis, wherein a rotational movement of the adjustor handle causes a movement of a slider to which the adjustor handle is connected, wherein the slider is linked to the moveable blade so as to activate a movement of the moveable blade in the first adjustment direction in response to the rotational movement of the adjustor handle, and wherein the slider is releasably connected to the comb attachment activating a movement of the comb attachment in the second adjustment direction in response to the rotational movement of the adjustor handle when the comb attachment is attached to the hair clipping device.

14. A hair clipping system, with a hair clipping device that comprises:

a housing;

a cutting assembly arranged on one end of said housing and comprising a stationary blade with a front edge and a moveable blade with a toothed edge arranged parallel to said front edge of the stationary blade, wherein the stationary blade is fixedly mounted to the housing and the moveable blade is displaceably mounted on a surface of the stationary blade and resiliently biased against said surface of the stationary blade;

a drive arrangement configured to drive said moveable blade in an oscillatory movement in a transverse direction substantially parallel to the front edge of the stationary blade;

an adjustment unit configured to adjust a position of the moveable blade with respect to the stationary blade in an adjustment direction substantially perpendicular to said transverse direction; and with an additional attachment that can be releasably attached to the hair clipping device on a side of the stationary blade facing away from said surface of said stationary blade, the additional attachment being a separate part from the stationary blade;

wherein said attachment comprises a blocking element that is adapted to block the adjustment of the position of the moveable blade by the adjustment unit and to push the moveable blade to a predefined position with respect to the stationary blade in the first adjustment direction, when said attachment is attached to the hair clipping device.

* * * * *